US006328874B1

(12) United States Patent
Kinlen et al.

(10) Patent No.: US 6,328,874 B1
(45) **Date of Patent: *Dec. 11, 2001**

(54) ANODICALLY FORMED INTRINSICALLY CONDUCTIVE POLYMER-ALUMINUM OXIDE COMPOSITE AS A COATING ON ALUMINUM

(75) Inventors: Patrick J. Kinlen, Fenton; Lawrence M. Lawless, Chesterfield; Vinod P. Menon, St. Louis, all of MO (US)

(73) Assignee: McDonnell Douglas Corporation, St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/002,582

(22) Filed: Jan. 5, 1998

(51) Int. Cl.[7] ..... C25D 11/00

(52) U.S. Cl. ..... 205/317; 205/332

(58) Field of Search ..... 428/411.1, 461, 428/500; 205/317, 324, 330, 332

(56) References Cited

U.S. PATENT DOCUMENTS

| | | | | |
|---|---|---|---|---|
| 4,578,156 | * | 3/1986 | Platzer | 204/33 |
| 4,780,796 | | 10/1988 | Fukuda et al. | 361/525 |
| 4,855,361 | | 8/1989 | Yaniger et al. | 525/436 |
| 4,948,685 | | 8/1990 | Ohsawa et al. | 429/213 |
| 4,999,263 | | 3/1991 | Kabata et al. | 429/131 |
| 5,006,278 | | 4/1991 | Elsenbaumer | 427/385.5 |
| 5,079,334 | | 1/1992 | Epstein et al. | 528/210 |
| 5,290,483 | | 3/1994 | Klukarni et al. | 252/500 |
| 5,312,686 | | 5/1994 | MacDiarmid et al. | 428/364 |
| 5,370,825 | | 12/1994 | Angelopoulos et al. | 252/500 |
| 5,378,402 | | 1/1995 | Cross et al. | 252/500 |
| 5,437,943 | | 8/1995 | Fujii et al. | 429/312 |
| 5,441,772 | | 8/1995 | McAndrew et al. | 427/388.1 |
| 5,484,884 | | 1/1996 | MacDiarmid et al. | 528/422 |
| 5,489,400 | | 2/1996 | Liu et al. | 252/500 |
| 5,494,609 | | 2/1996 | Kulkarni et al. | 252/500 |
| 5,519,111 | | 5/1996 | MacDiarmid et al. | 528/422 |
| 5,532,025 | | 7/1996 | Kinlen et al. | 427/388.1 |
| 5,543,084 | | 8/1996 | Kinlen et al. | 252/500 |
| 5,556,518 | | 9/1996 | Kinlen et al. | 204/484 |
| 5,567,209 | | 10/1996 | Kobayashi et al. | 29/25.03 |
| 5,586,001 | | 12/1996 | Amano et al. | 361/525 |
| 5,980,723 | * | 11/1999 | Runge-Marchese et al. | 205/316 |

FOREIGN PATENT DOCUMENTS

| | | | |
|---|---|---|---|
| 591035 | * | 5/1994 | (EP) . |
| 5003138 | | 1/1993 | (JP) . |
| 6045195 | | 2/1994 | (JP) . |
| 6045196 | | 2/1994 | (JP) . |
| 6045199 | | 2/1994 | (JP) . |
| 6045200 | | 2/1994 | (JP) . |
| WO 93/14166 | | 1/1993 | (WO) . |

OTHER PUBLICATIONS

Frederick A. Lowenheim, Electroplating, 1978, 455–459, 464–465, No month avail.*

Encyclopedia of Polymer Science and Engineering, vol. 3, Coating Methods: Electrostatic Power–spray Coating, pp. 583–589.*

F. Beck, A Novel Way To Corrosion Protection: The Electrochemical Deposition Of Conducting Polymers; *Metalloberflaeche*, 46(4):177–182 (1992).

LI et al., Corrosion Resistance Of Polyaniline Film, *Beijing Keji Daxue Xuebao BKDXE2*, 13(4):367–372 (1991).

Chen et al., Polyaniline Doped By The New Class Of Dopant, Ionic Salt: Structure And Properties, *Macromolecules*, 28:1239–1245 (1995).

DeBerry, Modification Of The Electrochemical And Corrosion Behavior Of Stainless Steels With An Electroactive Coating, *J. Electrochem. Soc.*, 132(5):1022–1026 (1985).

Deng et al., Stabilization Of Metal–Metal Oxide Surfaces Using Electroactive Polymer Films, *J. Electrochem. Soc.*, 136(8):2152–2158 (1989).

Geskin, Electrodeposition Of Polyaniline Onto Non–Noble Metals II. Nickel, *J. Chem. Phys.*, 89:1221–1226 (1992).

P. Hulser et al., Electrodeposition Of Polypyrrole Layers On Aluminium From Aqueous Electrolytes, *Journal Of Applied Electrochemistry*, 20:596–605 (1990).

Hwang et al., Morphological Modification Of Polyaniline Using Polyelectrolyte Template Molecules, *Synthetic Metals*, 29:E271–E276 (1989).

Hyodo et al., Effect Of The Polymer Electrolyte On The Electrochemical Polymerization Of Aniline, *Electrochimica Acta*, 36(1):87–91 (1991).

Jasty et al., Corrosion Prevention Capability Of Polyaniline (Emeraldine Base And Salt): An XPS Study, *Department of Physics and Department of Chemistry, The Ohio State University*, 565–566.

Liu et al., Novel Template Guided Synthesis Of Polyaniline, *Materials Res. Soc. Symp.*, 328:601–606 (1994).

Lu et al., Corrosion Protection Of Mild Steel By Coatings Containing Polyaniline, *Synthetic Metals*, 71:2163–2166 (1995).

(List continued on next page.)

*Primary Examiner*—Kathryn Gorgos
*Assistant Examiner*—Wesley A. Nicolas
(74) *Attorney, Agent, or Firm*—Alston & Bird LLP

(57) ABSTRACT

A method for forming a coating on aluminum by contacting the aluminum with water, at least one multifunctional polymeric organic acid, a monomer of an intrinsically conductive polymer (ICP) and polymerizing the ICP monomer and forming aluminum oxide by imposing an electrical potential between the aluminum surface as the anode and a cathode. The intrinsically conductive polymer salt and aluminum oxide coating that is formed resists corrosion and is resistant to de-doping during immersion in hot water.

28 Claims, 8 Drawing Sheets

(4 of 8 Drawing Sheet(s) Filed in Color)

OTHER PUBLICATIONS

Masuda et al., Self–Ordering Of Cell Arrangement Of Anodic Porous Alumina Formed In Sulfuric Acid Solution, *J. Electrochem. Soc.*, 2127–2130 (1997).

Mattson, The Synthesis Of Conducting Polymers For Corrosion Prevention, University of Central Florida, Chemistry Department, 188–129 (1988).

McAndrew, Corrosion Prevention With Electrically Conductive Polymers, TRIP, 5(1):7–12 (1997).

Racicot et al., Thin Film Conductive Polymers On Aluminum Surfaces: Interfacial Charge–Transfer And Anti–Corrosion Aspects, Optical And Photonic Applications Of Electroactive And Conducting Polymers, 2528(P):251–258 (1995).

Racicot et al., Anti–Corrosion Studies Of Novel Conductive Polymer Coatings On Aluminum Alloys, Materials Research Society, (1996).

Racicot et al., Corrosion Protection Comparison Of A Chromate Conversion Coating To A Novel Conductive Polymer Coating On Aluminum Alloys, *Corrosion* 97, Paper No. 531:1–7 (1997).

Racicot et al., Corrosion Protection Of Aluminum, Alloys By Double–Strand Polyaniline, *Synthetic Metals*, 85:1263–1264 (1997).

Ren et al., Electrochemically Prepared Poly(3–methylthiophene) Films For Passivation Of 430 Stainless Steel, *J. Electrochem. Soc.*, 139(4):1021–1026 (1992).

Sun et al., Conducting Polymer With Improved Long–Time Stability: Polyaniline–Polyelectrolyte Complex, *Mat. Res. Soc. Symp. Proc.*, 328 (1993).

Thompson et al., Corrosion–Protective Coatings From Electrically Conducting Polymers, *Materials Science And Technology Division, Los Alamos National Laboratory*, (1991).

Troch–Nagels et al., Electron Conducting Organic Coating Of Mild Steel By Electropolymerization, *Journal Of Applied Electrochemistry*, 22:756–764 (1992).

Wessling, Passivation Of Metals By Coating With Polyaniline: Corrosion Potential Shift And Morphological Changes, *Advanced Materials*, 6(3):226–228 (1994).

Zhang et al., Polyaniline: Kinetics Of Electrochemical Doping Studied By Time Resolved Absorption Spectroscopy, *Synthetic Metals*, 29:E251–256 (1989).

* cited by examiner

ANODICALLY FORMED INTRINSICALLY CONDUCTIVE POLYMER-ALUMINUM OXIDE COMPOSITE AS A COATING ON ALUMINUM

BACKGROUND OF THE INVENTION

1. Field of the Invention

The present invention relates to coatings for oxidizable metals, and more particularly to corrosion-resistant coatings containing intrinsically conductive polymers; to methods for using such coatings to protect oxidizable metals from corrosion; to oxidizable metal surfaces protected from corrosion by such coatings; and to compositions that may be used to form such coatings.

2. Description of Related Art

Coatings for metals are important in a number of applications, one of which is the protection of the metal from corrosion. Corrosion resistant coatings for metals are designed: (1) to form a barrier between the metal and the environment; (2) to provide cathodic protection of the metal, as with a zinc-rich primer; and/or (3) to passivate the metal, as with a heavy metal oxide of, for example, chromium or molybdate. Problems in providing barrier coatings free of pin-holes and environmental concerns about heavy metals have resulted in increased interest in protective coatings that include intrinsically conductive polymers.

Intrinsically conducting polymers (ICP's), are polymers such as polyaniline, polypyrrole and polythiophene that have poly-conjugated π-electron systems and that conduct electricity in at least one valence state. It is believed that coatings for metals that contain ICP's have conductivity properties that passivate and protect the metal from corrosion; even where the coating is penetrated by pin-holes or scratches. However, limitations in the processability of ICP's along with the brittleness and lack of strength and adherence of films composed only of ICP's has limited their commercial application. See, for example, Deng, et al., *J. Electrochem. Soc.*, 136:2152–2157, 1989; Ren and Barkey, *J. Electrochem. Soc.*, 139:1021–1026, 1992; Wessling, Adv. Mater., 6:226–228, 1994; and Lu, et al., *Synth. Metals*, 71:2163–2166, 1995.

ICP's can be incorporated into corrosion resistant coatings by applying a film that includes a dispersion or solution of the polymer, or by polymerization of an ICP monomer into an ICP in situ onto the surface to be protected, by either chemical or electrochemical means.

A film containing an ICP in polymer form can be applied to a surface in the form of a paint or liquid coating formulation. The carrier solvents can then be evaporated leaving the ICP in the form of a film on the surface to be protected. Use of an ICP in polymer form has the advantage of permitting the production of the ICP under conditions that are optimum for the desired molecular weight and conductivity properties, but such method also requires the use of a solvent and the evaporation of the solvent can cause air pollution problems.

Alternative methods of application of ICP's in polymer form can be electrodeposition (See, e.g., U.S. Pat. Nos. 5,543,084 and 5,556,518), or incorporation of ICP's into formulated coatings, (See, e.g., U.S. Pat. Nos. 5,494,609, 5,290,483, 5,006,278, 5,532,025, JP 5003138 A, JP 6045196 A and JP 6045195 A), or paints, (See, e.g., U.S. Pat. No. 5,441,772 and PCT Publ. No. WO93/14166).

It has been reported that anti-corrosion films containing polyaniline having improved thermal and pH stability against de-doping can be produced by the use of so-called, "double-strand" polyaniline. (See, e.g., Sun, et al., *Mat. Res. Soc. Symp. Proc.*, 328, 1993; Racicot, et al., *Synth. Metals*, 85:1263–1264, 1997; U.S. Pat. No. 5,489,400 to Liu et al.; Racicot et al., SPIE Reprint: *Optical and photonic applications of electroactive and conducting polymers*, 2528:251–258, 1995; Racicot, et al., *Mat. Res. Soc. Symp. Proc.*, 413:529, 1996, and Racicot et al., *Corrosion protection comparison of a chromate conversion coating to a novel conductive polymer coating on aluminum alloys*, Paper No. 531, Corrosion 97, NACE International, 1997). Such polyanilines are produced by chemical polymerization of aniline in the presence of a multifunctional polymeric acid ("polyacid") such as polystyrenesulfonic acid or poly (methylacrylate-co-acrylic acid) to form a complex of the polyaniline and the polymeric acid. It is believed that the tight binding of the large multi-anionic polymeric acid with the amine groups of the polyaniline enhanced the stability of the doped form of the polyaniline to de-doping by high temperatures and basic pH values. The group reported promising use of a polyaniline/poly(methylacrylate-co-acrylic acid) complex as an anti-corrosion coating for aluminum when the complex was dissolved in ethyl acetate and applied to cleaned and polished aluminum alloys AA7075 and AA2024 as a liquid. Upon evaporation of the solvent, the complex formed a film that was reported to have a corrosion current density that was 2 to 3 orders of magnitude lower than a conventional anodized aluminum oxide film. None of these references, however, reported film formation by in situ electrochemical polymerization. In fact, U.S. Pat. No. 5,489,400 contrasted the process of electrochemical polymerization as being quite different from those of the "template guided" chemical polymerization preferred in that invention. It was also stated that the molecular complexes made by chemical polymerization are also quite different from those made by electrochemical polymerization.

Formation of polyaniline by electropolymerization from aqueous solutions that also contained a polyacid has been reported by Hyodo et al., in *Electrochemical Acta*, 36:87–91, 1991, and by Hwang and Yang, in *Synthetic Metals*, 29:E271–E276, 1989. Neither of these references deposited ICP films on aluminum, however, and all electrooxidation was carried out at electrical potentials under 0.75 volts. In fact, Hyodo et al. stated that polyaniline degradation was suppressed by limiting cell potential to 0.75 volts.

In situ chemical polymerization of ICP's into films on metal surfaces has been reported for the construction of electrical batteries and capacitors. Although the art of producing batteries and capacitors is not closely related to the formation of corrosion-resistant coatings, it has been found that such solid state devices can be formed from a layer of ICP's deposited on a valve action metal, such as aluminum or tantalum, with an interlayer of a dielectric, such as the metal oxide. These techniques first require the formation of a metal oxide layer on the surface of the metal and then coat the oxide with the ICP. The ICP can be applied in polymer form as previously described, or it may be polymerized in situ (i.e., polymerized on the surface of the oxide to form an ICP film). In situ polymerization can be carried out by applying to the metal oxide either a monomer polymerizable into an ICP (ICP monomer) followed by contact with a separate solution of a chemical oxidant, (See, e.g., U.S. Pat. No. 5,567,209), or first applying a chemical oxidant followed by a solution containing an ICP monomer, (U.S. Pat. No. 4,780,796). Other methods form a first ICP layer by chemical polymerization and then apply an additional layer of a second ICP by electrochemical polymerization. See, e.g., EP 591035, U.S. Pat. No. 4,780,796, JP 6045200 A and JP 6045199 A. The advantage cited for such two-stage application of the ICP layer is that the insulating properties of the metal oxide layer make it impossible, or, at least, difficult, to deposit the ICP electrochemically, (See, e.g., U.S. Pat. No. 4,780,796).

Ohsawa et al. (U.S. Pat. No. 4,948,685 and U.S. Pat. No. 4,999,263), however, used electrochemical polymerization of polyaniline to form sheet-shaped electrodes and demonstrated the electrochemical polymerization of polyaniline onto nickel, stainless steel and substantially pure, surface-roughened aluminum at electrode potentials of up to 1.2 volts versus a saturated calomel electrode (V/SCE) in aqueous solutions of acids having $pK_a$ values between −2.5 and +2.5. Sulfuric and p-toluenesulfonic acids were successfully used for the electropolymerization, but no polyaniline film was produced on aluminum when acids having $pK_a$ values of about 3 (nitric), 3.1 (perchloric), 3.2 (hydrofluoric) 4.0 (hydrochloric) and 4.9 (tetrafluoroboric) were used. It was thought that the surface-roughening procedure facilitated the formation of the ICP film even when electrochemical polymerization was used after an oxide layer had formed on the metal.

Application of an ICP coating by electrochemical means to a metal surface to be protected from corrosion would offer several advantages over the application of the coating as a paint. For example, the metal is usually highly conductive and makes a good electrode, anodic electropolymerization of ICP monomers is well known and does not require the use of expensive chemical oxidants and electropolymerization of ICP monomers does not produce by-product salts. In addition, electrochemical polymerization provides the immersed metal surface with throrough coverage by the ICP film. However, attempts to form corrosion-resistant ICP coatings on oxidizable metals by direct electropolymerization have encountered problems. Many of these problems center around how to carry out the electropolymerization while maintaining a conductive form of the ICP. Such problems include the formation of an unwanted oxide layer that prevented or hindered the synthesis of an ICP film at voltages that were sufficiently low to avoid over-oxidation of the ICP; the synthesis of weak, powdery films, in some cases due to over-oxidation; and the inability to incorporate other components into the film to improve its strength and adherence.

DeBerry, *J. Electrochem. Soc.*, 132(5):1022–1026, 1985, deposited polyaniline coatings on ferritic stainless steels by electropolymerization. The metal substrate to be coated served as the anode, or working electrode, in an electrochemical cell containing 1.0 M aniline in aqueous pH 1.0 perchloric acid solution. The polyaniline coating was formed by cycling the working electrode potential between about −0.2 and +1.1 volts versus a saturated calomel electrode. It was reported that the polyaniline coatings were deposited over a passive metal oxide film, but could undergo electron transfer with the metals, and it was stated that the possibility that the polyaniline may penetrate the oxide film could not be ruled out. Polyaniline coated stainless steels, even with scratches through the coatings, remained passive for long periods of time in acid solutions which would normally attack the steels at high rates of corrosion, but the stability of the coatings was inconsistent and strongly dependent on the methods used before, during and after electropolymerization.

Later work by Geskin, *J. Chem. Phys.*, 89:1221–1226, 1992, reported the deposition of polyaniline onto nickel to minimize corrosion. Degreased nickel sheets and nickel sputtered onto insulating substrates were used as working electrodes in an electrochemical bath containing 1.0 M sulfuric acid in aqueous solution with 0.4 M aniline. Initial immersion of the nickel into the bath at a potential of 0.6 volts and then cycling through the normal aniline oxidation range of from about −0.2–+1.0 volts deposited polyaniline films on the metal, but potentials exceeding 1.5 V caused oxygen evolution at the electrode surface and prevented coating with the polymer and also led to over-oxidation of polyaniline. The best coatings were obtained at 1.4 V.

More recently, Beck, Metalloberflaeche, 46(4):177–182, 1992, surveyed literature reports of the electropolymerization of polypyrrole and polythiophene to give highly adhesive films that provided corrosion protection to metals such as iron, aluminum and copper. Polypyrrole coatings on such base metals that have a tendency for active anodic dissolution were reported in special electrolytes such as aqueous solutions of 0.1 M potassium nitrate, 0.1 M oxalic acid, phosphate buffer and 0.1 M tetraethylammonium paratoluenesulfonate in propylene carbonate. Cell potentials of between 0.5–0.9 volts were indicated. Polybisthiophene coatings were deposited from a solution of 0.1 M potassium nitrate in 60 vol. % acetonitrile. Anodic co-deposition of polypyrrole and such powdery solid pigments as titanium dioxide, carbon black and the like was discussed. The possibility of applying such ICP's to metals as a replacement for galvanizing or phosphatizing as base coats for conventional metal coatings was also mentioned.

However, at about the same time, a separate group attempted to coat stainless steel and mild steel by the electropolymerization of aniline, pyrrole, furan and thiophene. According to Troch-Nagels, et al., in *J. of Appl. Electrochem.*, 22:756–764, 1992, attempts to coat mild steel with polyaniline in neutral and basic solutions of water and methanol at between 0.8–1.5 V/SCE yielded non-conductive brown films. In 20 vol. % methanol and 0.13 M sulfuric acid, no films were produced below 0.8 V/SCE and poor quality, black and powdery films were produced when the potential was above 1.4 V/SCE. Polyaniline films also were reported to have been produced from 0.3 M aniline solutions in 0.1 M nitric acid with electrode potentials cycling between about −0.5–+1.5 V/SCE, but the films were powdery and brittle. While better films were reported to have been made on mild steel from 0.5 M pyrrole in 0.08 M sodium sulfate at 0.8–1.4 V/SCE, adhesion was reported to have been poor.

No suitable films were formed from either furan or thiophene. Troch-Nagels, et al. concluded that polyaniline films on mild steel did not meet the requirements for industrialization because they were brittle, did not allow anaphoretic painting and did not improve corrosion resistance. Polypyrrole films were discovered to be slightly better, but their adhesion was found to be poor and the films were brittle. Aluminum was not included in the work.

More success was reported by Li, et al., *Beijing Keji Daxue Kuebao*, 13(4):367–372, 1991, for the electropolymerization of polyaniline films onto stainless steel and carbon steel from solutions of aniline in sulfuric acid. It was reported that the films lowered the corrosion current densities by about three orders of magnitude, but the films would dissolve and fall off because of over-oxidation when the polymerization potential arose to 0.65 V in NaCl or 0.9 V in sulfuric acid.

Additional questions are associated with the use of ICP's in corrosion resistant films. For example, there is debate whether it matters if the ICP is in the conductive or the nonconductive form, or, whether the film itself is conductive or nonconductive. Although much of the work reported in this area suggests that the conductive form of the ICP is more effective for corrosion resistance (See, e.g., Mattson, "The Synthesis of Conducting Polymers for Corrosion Prevention", Final Report on NASA Contract NASA-NGT-60002, N89-14159, 1988; Thompson, et al., "Corrosion-Protective Coatings from Electrically Conductive Polymers", Proceedings from Technology 2001, San Jose, Calif., 1991; U.S. Pat. No. 4,855,361; and U.S. Pat. No. 5,006,278), other reports maintain that the nonconductive form is superior (See, e.g., U.S. Pat. No. 5,441,772). Thus, it is not obvious from the prior art which form of the ICP is more effective for corrosion resistant films and coatings.

A further problem that has been found to hinder the commercialization of doped ICP coatings has been the tendency of the dopant to leach out of the film during exposure to water. Such loss of the dopant will, in time, leave the film will little or no electrical conductivity. This problem has been encountered during exposure to rain and also during processing, such as, for example, during hot water sealing of anodized aluminum surfaces.

In view of these efforts, it is clear that despite the potential advantages offered by the polymerization of ICP monomers directly onto metal surfaces to form on such surfaces corrosion resistant coatings comprising ICP's, problems remain which have restrained the commercial use of such films to protect oxidizable metals such as aluminum. Accordingly, it would be desirable to provide methods for forming ICP-containing films on aluminum that improve its resistance to pitting-type corrosion, especially in salt environments. It would also be desirable to provide methods that were capable of forming such films despite the presence of aluminum oxide films on the aluminum surface and without tendency toward over-oxidizing the ICP during formation. It would also be desirable to provide methods to produce such ICP-containing films wherein the ICP is present in the doped, conductive form and will remain in that form without de-doping during hot water sealing, or environmental exposure. Moreover, it would be desirable to provide methods to protect aluminum from corrosion by the application of such a coating as just described. It would also be desirable to provide an aluminum surface that was protected from corrosion by a coating such as described. Finally, it would be desirable to provide a composition from which such a coating could be formed.

SUMMARY OF THE INVENTION

Briefly, therefore, the present invention is directed to a novel coating for an aluminum surface comprising aluminum oxide intermixed with a multifunctional polymeric organic acid salt of an intrinsically conductive polymer.

In addition, the present invention includes a novel bath liquid for anodically forming a corrosion resistant coating on an aluminum surface comprising water, a multifunctional polymeric organic acid, a monomer of an intrinsically conductive polymer and a dibasic acid.

Furthermore, the present invention provides a novel method for protecting an aluminum surface from corrosion comprising, contacting the aluminum surface with a mixture of water, a multifunctional polymeric organic acid and a monomer of an intrinsically conductive polymer and imposing an electrical potential between the aluminum surface as the anode and a cathode, where the electrical potential is sufficient to polymerize the monomer of the intrinsically conductive polymer and to form aluminum oxide, thereby forming on the aluminum surface a coating of the multifunctional polymeric organic acid salt of the intrinsically conductive polymer intermixed with aluminum oxide. An aluminum surface protected by this method is also provided.

Moreover, a method is provided for forming a coating on an aluminum surface comprising, contacting the aluminum surface with a mixture of water, a polybasic acid and a monomer of an intrinsically conductive polymer and imposing an electrical potential of at least about 15 volts between the aluminum surface as the anode and a cathode, thereby polymerizing the monomer of the intrinsically conductive polymer and forming aluminum oxide and thereby forming on the aluminum surface a coating of the polybasic acid salt of the intrinsically conductive polymer intermixed with aluminum oxide.

In addition, the present invention includes a novel aluminum surface protected against corrosion, comprising an aluminum surface on which is disposed a corrosion resistant coating comprising a multifunctional polymeric organic acid salt of an intrinsically conductive polymer intermixed with aluminum oxide, wherein the intrinsically conductive polymer remains in a doped form after immersion for 15 minutes in water at a temperature of 60° C.

Among the several advantages found to be achieved by the present invention, therefore, may be noted the provision of methods for forming ICP-containing films on aluminum that improve its resistance to pitting-type corrosion, especially in salt environments; also the provision of such methods that are capable of forming such films despite the presence of aluminum oxide films on the aluminum surface and without over-oxidizing the ICP during formation; the provision of such methods that produce such ICP-containing films wherein the ICP is present in the doped, conductive form and will remain in that form without de-doping during hot water sealing, or environmental exposure; the provision of such methods that protect aluminum from corrosion by the application of such a coating as just described; the provision of an aluminum surface that is protected from corrosion by a coating such as described; and the provision of an anodization bath liquid from which such a coating can be formed.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DETAILED DESCRIPTION OF THE PREFERRED EMBODIMENTS

Figure 1A:
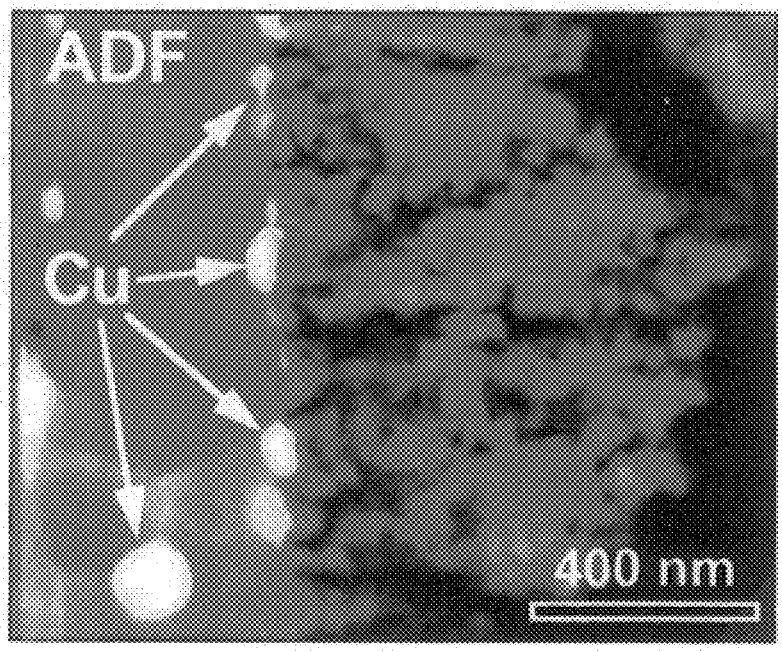
FIGS. 1*a–c* show three annular dark field images of different regions of a cross section of a coating of aluminum oxide/sulfuric acid-doped polyaniline on a 2024 aluminum alloy surface that illustrate, (a) the porous aluminum oxide/polyaniline coating on the right and the aluminum alloy on the left with regions of copper concentration indicated, (b) "columnar", or "pillar"-type porous aluminum oxide/polyaniline coating on the right that is tighly attached to and integral with the aluminum alloy on the left and, (c) aluminum oxide/polyaniline coating on the right in irregular, "pillar"-type porous structure that covers and is integral with the aluminum alloy on the left.

In accordance with the present invention, it has been discovered that a coating can be provided for aluminum by contacting the aluminum surface with water, a multifunctional polymeric organic acid (called herein a "polyacid") and a monomer of an intrinsically conductive polymer (called herein an "ICP monomer") and imposing an electrical potential between a cathode and the aluminum surface as the anode, wherein the electrical potential is sufficient to polymerize the ICP monomer and to form aluminum oxide concurrently with a multifunctional polymeric organic acid salt of an intrinsically conductive polymer (called herein an "ICP polyacid salt"). Surprisingly, the coating of aluminum oxide and ICP polyacid salt has been found to not only protect the aluminum from corrosion generally and pitting type corrosion in particular, even in salt environments, but also to remain in a doped state during immersion of the coating in hot water. In fact, the ICP polyacid salt remains in a doped state even after immersion in near-boiling water for over 30 minutes.

The polymerization produces a corrosion-resistant coating containing the aluminum oxide and the ICP polyacid salt formed during the polymerization. The ICP polyacid salt comprises an ICP that is protonated, or doped, by a polyacid. ICP's useful in the present invention are formed by the polymerization of any suitable substituted or unsubstituted acetylene, aromatic heterocyclic or aniline monomer. Generally, any substituted or unsubstituted acetylene, aromatic heterocyclic or aniline monomer that is polymerizable into an ICP may be used in this invention. Any such monomer may herinafter be referred to as an "ICP monomer".

The ICP Monomer:

The substituted or unsubstituted ICP monomers suitable for use in this invention include pyrrole and substituted pyrroles, acetylenes, p-phenylenes, m-phenylenes, phenylene sulfides, thiophene and substituted thiophenes, indoles, azulenes, furans and carbazoles. Aromatic heterocyclic compounds for use in the present invention include the 5-membered heterocyclic compounds having the formula:

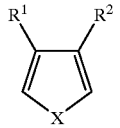

wherein each of $R^1$ and $R^2$ is independently hydrogen; alkyl (e.g., methyl or ethyl); aryl (e.g., phenyl); alkaryl (e.g., tolyl); or aralkyl (e.g., benzyl); or $R^1$ and $R^2$ together comprise the atoms necessary to complete a cyclic (e.g., benzo) structure; and X is —O—; —S—; or

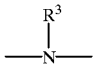

where $R^3$ is hydrogen, alkyl, aryl, alkaryl or aralkyl. These materials, upon electropolymerization, result in intrinsically conducting polymers having repeating units of the general formula:

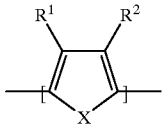

wherein: $R^1$, $R^2$ and X have the definitions set forth above.

In general, substituted or unsubstituted anilines for use in this invention are of the formula:

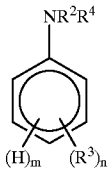

wherein:

n is an integer from 0 to 4;

m is an integer from 1 to 5, provided that the sum of n and m is equal to 5;

$R^2$ and $R^4$ are the same or different at each occurence and are hydrogen, or are selected from $R^3$ substituents; and $R^3$ is the same or different at each occurrence and is selected from alkyl, deuterium, alkenyl, alkoxy, cycloalkyl, cycloalkenyl, alkanoyl, alkythio, aryloxy, alkylthioalkyl, alkylaryl, arylalkyl, amino, alkylamino, dialkylamino, aryl, alkylsulfinyl, aryloxyalkyl, alkylsulfinylalkyl, alkoxyalkyl, phosphonic acid, alkylsulfonyl, arylthio, alkylsulfonylalkyl, borate, phosphate, sulfinate, arylsulfinyl, alkoxycarbonyl, arylsulfonyl, carboxylate, phosphonate, halogen, hydroxy, cyano, sulfinate, sulfonate, phosphinate, nitro, alkylsilane or alkyl substituted with one or more phosphonates, sulfonates, phosphates, borates, carboxylates, phosphinates, halo, nitro, cyano or epoxy moieties; or any two $R^3$ groups together or any $R^3$ group together with any $R^2$ or $R^4$ group may form an alkylene or alkenylene chain completing a 3, 4, 5, 6 or 7 membered aromatic or alicyclic ring, which ring may optionally include one or more divalent nitrogen, sulfur, sulfinyl, ester, carbonyl, sulfonyl, or oxygen atoms; or $R^3$ is a divalent organic moiety bonded to the same or a different substituted or unsubstituted aniline moiety or $R^3$ is an aliphatic moiety having repeat units of the formula:

$$-(OCH_2CH_2)_q-O-CH_3,\quad -(OCH_2CH(CH_3))_q-O-CH_3,$$
$$-(CH_2)_q-CF_3,\quad -(CF_2)_q-CF_3,\quad \text{or}\quad -(CH_2)_q-CH_3$$

wherein q is a positive whole number; provided that said homopolymer and copolymer includes about 10 or more recurring substituted or unsubstituted aniline aromatic moieties in the polymer backbone.

The following substituted and unsubstituted anilines are illustrative of those which can be used in the synthesis of polyaniline in that embodiment wherein polyaniline is the ICP component of the composite film: 2-cyclohexylaniline, aniline, o-toluidine, 4-propanoaniline, 2-(methylamino) aniline, 2-dimethylaminoaniline, 2-methyl-4-methoxycarbonylaniline, 4-carboxyaniline, N-methyl aniline, N-propyl aniline, N-hexyl aniline, m-toluidine, o-ethylaniline, m-ethylaniline, o-ethoxyaniline, m-butylaniline, m-hexylaniline, m-octylaniline, 4-bromoaniline, 2-bromoaniline, 3-bromoaniline, 3-acetamidoaniline, 4-acetamidoaniline, 5-chloro-2-methoxy-aniline, 5-chloro-2-ethoxy-aniline, N hexyl-m-toluidine, 2-acetylaniline, 2,5 dimethylaniline, 2,3 dimethylaniline, N,N dimethylaniline, 4-benzylaniline, 4-aminoaniline, 2-methylthiomethylaniline, 4-(2,4-dimethylphenyl) aniline, 2-ethylthioaniline, N-methyl-2,4-dimethylaniline, N-propyl m-toluidine, N-methyl o-cyanoaniline, 2,5 dibutylaniline, 2,5 dimethoxyaniline, tetrahydronaphthylaniline, o-cyanoaniline, 2-thiomethylaniline, 2,5-dichloroaniline, 3-(n-butanesulfonic acid) aniline, 3-propoxymethylaniline, 2,4-dimethoxyaniline, 4-mercaptoaniline, 4-ethylthioaniline, 3-phenoxyaniline, 4-phenoxyaniline, 4-phenylthioaniline, 3-amino-9-methylcarbazole, 4-amino carbazole, N-octyl-m-toluidine, 4-trimethylsilylaniline, 3-aminocarbazole, N-(paraaminophenyl) aniline. The most preferred ICP monomer is unsubstituted aniline.

The Polyacid:

Multifunctional polymeric organic acids ("polyacids") that are useful in the invention are selected from polymers having substituent anionic functional groups such as carboxylic, sulfonic, sulfinic, phosphoric, phosphonic, phosphinic, or the salt forms of such anionic functional groups. While the molecular weight of the polyacid is not critical, preferred polyacids have a molecular weight that is sufficiently high to substantially prevent evaporation of the polyacid at ambient conditions and to substantially prevent diffusion of the ICP salt out of the corrosion resistant coating when the coating is immersed in water. For example, such polyacids have a weight average molecular weight range that is preferably from about 20,000 to about 150,000, more preferably about 40,000 to about 100,000 and most preferably about 50,000 to about 80,000.

Although the inventors do not wish to be bound by this or any other particular theory, it is believed that the "intimate" binding that is obtained between the polyacid and ICP's, such as polyaniline, is the main reason for the environmental stability and resistance to leaching of the subject ICP polyacid salt after formation of the coating. Again, without wishing to be bound to this or any other particular theory, it is believed that preferred polyacids are capable of more interactive binding with the ICP than mere Coulombic attraction to positive ions, such as the protonated amine groups of polyaniline, by the ionized anionic polyacid. For example, it is believed that the un-ionized groups of the polyacid can also form hydrogen bonding forces with a base functionality of the ICP and that the organic groups of the polyacid counter-ion can form hydrophobic interactions with, for example, the phenyl groups of polyaniline. Such multiple forms of polyacid/ICP binding are believed to result in the "intimate" binding that causes the doped-ICP to be retained in the coating of the invention without leaching out during immersion in water. Such polyacids and their binding interaction with, for example, polyaniline are described in U.S. Pat. No. 5,489,400, and also by Liu et al., in *Mat. Res. Soc. Symp. Proc.*, 247:601, 1992, and by Hwang and Yang in *Synth. Met.*, 29:E271–E276, 1989, each of which references is incorporated herein by reference.

Polyacids preferred for use in this invention include poly(styrene sulfonic acid), poly(styrene phosphonic acid), poly(vinyl sulfuric acid), poly(vinyl sulfonic acid), poly (lactic acid), poly(aspartic acid), poly(glycolic acid), poly (vinyl phosphonic acid), poly(acrylic acid), poly(2-acrylamido-2-methyl-1-propenesulfonic acid), poly (butadiene-maleic acid), poly(methacrylic acid), and copolymers thereof and the salt forms thereof. A more preferred polyacid is poly(styrene sulfonic acid) (PSSA).

Figure 1B:
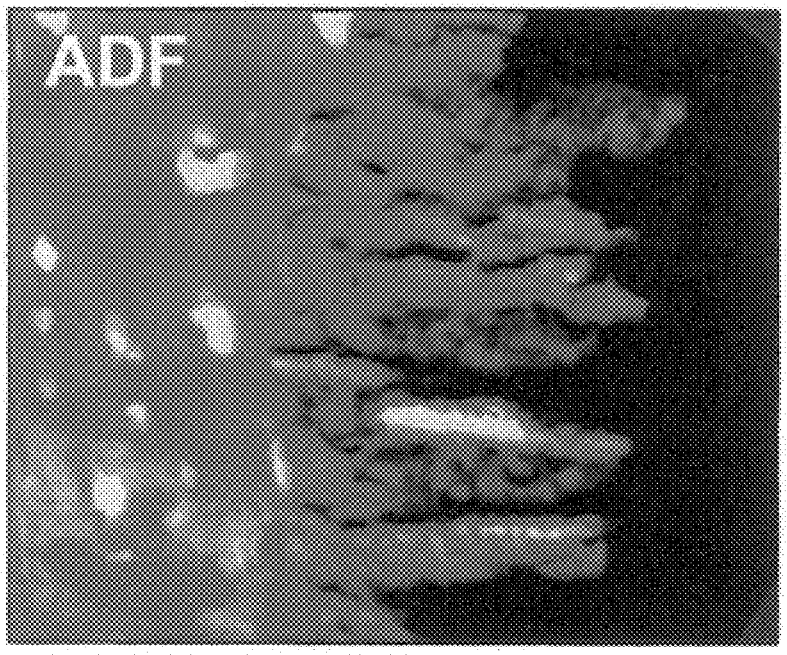
Figure 1C:
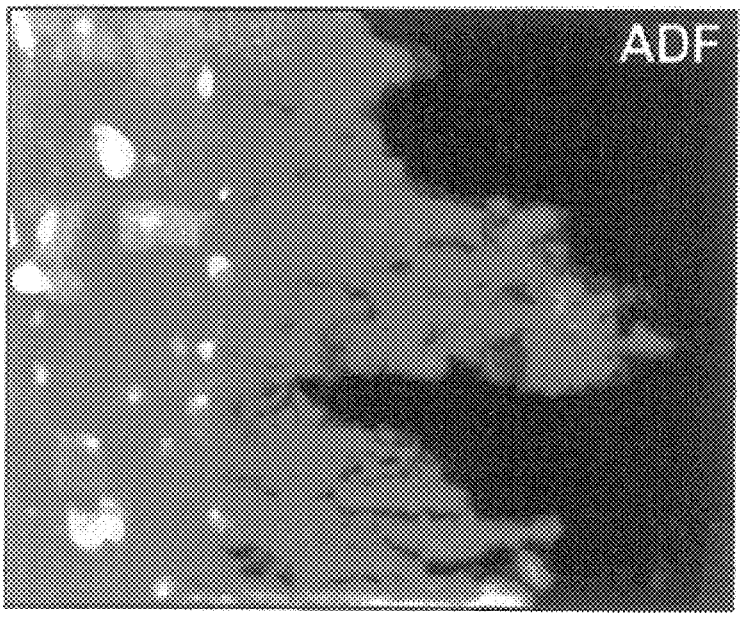
Figure 2A:
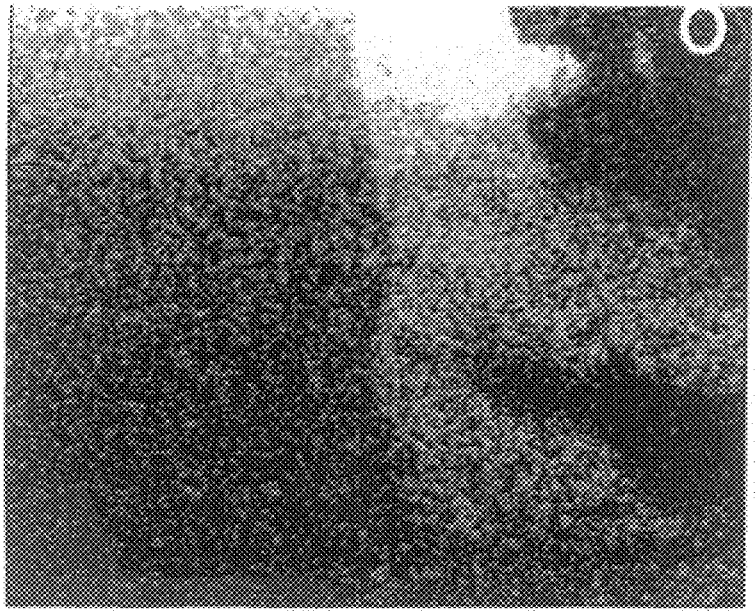
FIGS. 2*a–d* are a set of energy-dispersive elemental X-ray maps obtained from a dedicated scanning electron microscope each of which show the same cross section of the aluminum oxide/polyaniline coating as shown in FIG. 1(*c*) with elemental highlighting of the distribution of (a) oxygen, (b) aluminum, (c) sulfur, and (d) copper, and illustrating that the aluminum oxide coating substantially covers and is integral with the aluminum alloy surface.
Figure 2B:
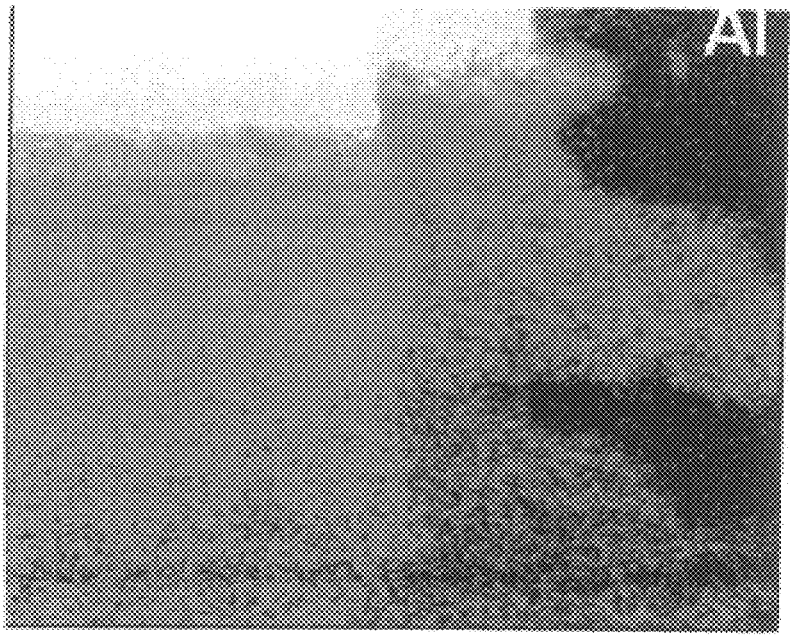
Figure 2C:
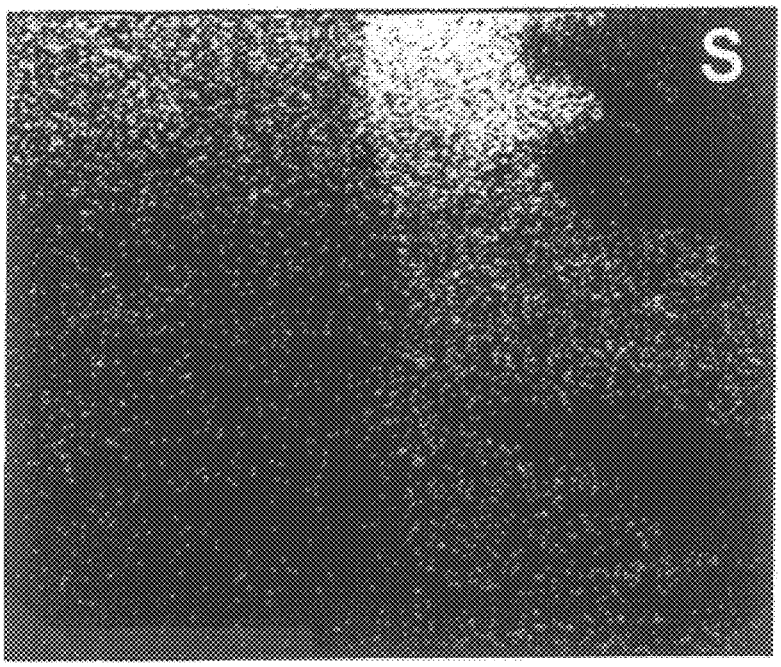
Figure 2D:
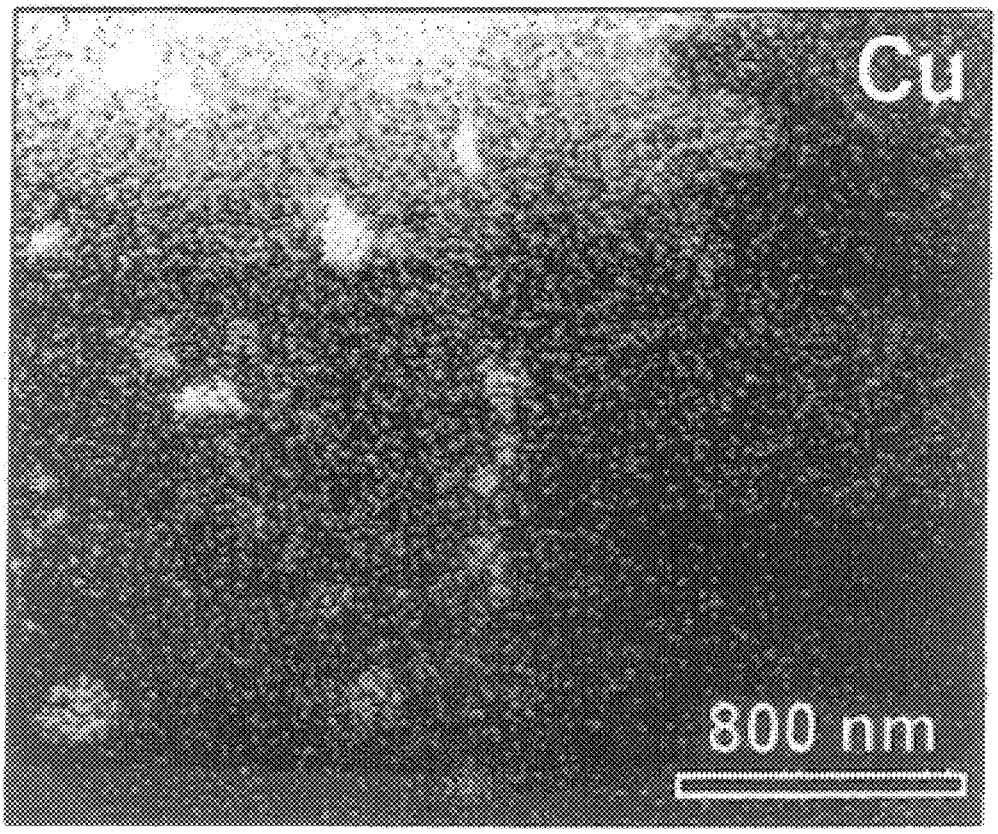

When a polyacid is present in the anodization bath, it is preferred, although not essential that a polybasic acid be present during the polymerization of the ICP monomer in addition to the polyacid. The presence of the polybasic acid has been found to facilitate the formation of a porous aluminum oxide coating on the surface of the aluminum. Porous aluminum oxide structures are known in the art and one type is discussed by Masuda et al., in J. Electrochem. Soc., _:2127–2130, 1997. While it not necessary to have an ordered porous structure of the type described by Masuda et al. for the present invention, it is believed to be necessary that the aluminum oxide coating be porous to some degree in order that the aluminum oxide and the ICP doped with polyacid form an interpenetrating matrix. FIGS. 1(*a*)–(*c*) illustrate cross-sections of a porous aluminum oxide film of the type that is suitable for use in the present coating that was formed in the presence of sulfuric acid.

The polybasic acid can be a dibasic, tribasic, or other polyfunctional acid and should be of a type, and be present in such concentration, to facilitate the formation of aluminum oxide in a porous structure. By contrast, use of monobasic acids, nitric acid and mineral acids have not been found to result in the formation of porous aluminum oxide. Sulfuric, oxalic, phosphoric, boric, salicic, and polybasic sulfonic and phosphonic acids are examples of suitable polybasic acids for use in the present method. Sulfuric acid is a preferred polybasic acid for this application.

If it is not required that the ICP salt of the resulting coating remain doped during immersion or contact with water, the polybasic acid can be the only acid that is used in the anodization bath. That is, the multifunctional polymeric organic acid can be replaced with only a polybasic acid.

The previously described components may be used at the purity normally obtained in commercial grade chemicals. Small amounts of impurities are not harmful to the formation of the subject coating so long as the impurities do not significantly interfere with the desired polymerization producing the ICP or with the formation of the ICP polyacid salt or the aluminum oxide.

Polymerization:

The corrosion resistant coating of the invention is formed by the electrochemical oxidation of the ICP monomer in the presence of a multifunctional polymeric organic acid in an aqueous solution, thereby forming a film of an ICP polyacid salt on the surface of the anode.

The ICP that is electrochemically polymerized can be a polyunsaturated homopolymer or copolymer having a polyconjugated n electron system along the polymer backbone and being electrically conductive in at least one valence state. As used herein, an ICP is electrically conductive if the conductivity of the ICP is at least about $10^{-8}$ S/cm. Preferably, the electrical conductivity of the ICP is at least about $10^{-6}$ S/cm and more preferably at least about $10^{-4}$ S/cm. Such ICP's are well known in the art and a comprehensive summary of ICP technology can be found in *Synthetic Metals*, vols. 17–19, 1987; vols. 28–30, 1989; and vols. 40–42, 1991, incorporated by reference herein.

Illustrative of ICP's useful in the subject coating are poly(unsaturated) polymers such as substituted and unsubstituted polyacetylenes; substituted or unsubstituted poly (heteroaromatics), such as polythiophenes, poly(furans), polypyrroles, polyquinolines, polyisothianaphthenes, polycarbazoles, poly(alkyl thiophenes) and the like; substituted or unsubstituted poly(aromatics) such as polyphenylene sulfides, polyanilines, polyphenylenes, polynaphthalenes and polyperinaphthalenes, poly(azulenes); and substituted or unsubstituted poly(aromatic vinylenes), such as poly(phenylene vinylene), poly(dimethoxy phenylene vinylene), poly(naphthalene vinylene) and the like; and substituted or unsubstituted poly(heteroaromatic vinylenes) such as poly(thienylene vinylene), poly(furylene vinylene), poly(carbazole vinylene), poly(pyrrole vinylene) and the like; and copolymers thereof. Preferred ICP homopolymer or copolymers are substituted or unsubstituted poly (heterocyclics), poly(anilines) and aromatic or heteroaromatic vinylenes. More preferred ICP's are polyanilines.

The oxidation also results in the formation of aluminum oxide concurrently with the formation of the ICP polyacid salt, thereby forming a composite coating of the aluminum oxide and the ICP polyacid salt. When the term "composite" is used in reference to the subject coating, it is meant that the aluminum oxide and the ICP polyacid salt that make up the coating are formed concurrently and are intermixed in the coating and that the coating therefore is an interpenetrating matrix of aluminum oxide and ICP polyacid salt.

When it is said that the subject coating is applied to aluminum, it is to be understood that pure aluminum and any and all alloys of aluminum are to be included. It has been found that some alloys of aluminum (i.e., copper alloys) that are exceptionally useful in, for example, the aircraft industry, are very amenable to the subject treatment. The utility of other aluminum alloys, such as, for example, alloys with magnesium, can be substantially enhanced by application of the subject coating due to their light weight, but high susceptibility to corrosion.

Although the ICP-containing film may be applied in any number of ways, for example, as particles carried in a paint or liquid film, it is preferable that the ICP-containing film be formed in situ, by electropolymerization of ICP monomers on the surface of the aluminum so that the aluminum oxide is formed by oxidation of the aluminum surface that is to be coated, resulting in at least part of the aluminum oxide in the corrosion resistant coating being integral with the aluminum surface. For one thing, it is believed that a coating with fewer pinholes and voids is obtained by electropolymerization as compared with painting. In addition, it is believed that the electropolymerized coating is more adherent and tenacious in binding to the aluminum surface. Concurrent formation of the aluminum oxide is believed to contribute to this superior tenacity and adherence of the subject coating.

Another advantage of the subject method of applying the coating by electropolymerization is that electropolymerization eliminates the need for dissolving the ICP salt in a volatile solvent and subsequently evaporating the solvent to form the coating. Thus, the present method uses fewer steps to produce the coating and avoids potentially dangerous fumes and air pollution problems that can be associated with solvent evaporation.

The subject coating can be formed in any electrochemical cell in which the aluminum surface to be coated can be submerged in a bath liquid and in which an electrical potential can be imposed between the aluminum anode and a cathode. The method of electrochemical synthesis of ICP's by use of electrochemical cells is well known and is generally described, for example, in *J. Chem. Soc., Faraday Trans.* 1, 82, 2385–2400 (1986), *J. Electrochem. Soc.*, Vol 130, No. 7, 1508–1509 (1983), *Electrochem. Acta*, Vol. 27, No. 1, 61–65 (1982), and *J. Chem. Soc. Chem. Commun.*, 1199 (1984), each of which is incorporated herein by reference. Anodization of aluminum for corrosion protection is well known and is described in general in the *Encyclopedia of Electrochemistry of the Elements*, Ed., Alan J. Bard, Vol. 6, Chapter VI-3, pp. 63–165, Marcel Dekker, Inc., New York, 1976, which is incorporated herein by reference. Common standards for such anodic coatings for aluminum are provided in Military Specification, MIL-A-8625E, which is hereby incorporated by reference.

By way of example, a common sulfuric acid anodization solution can be made up from 9.5 gal. of 66° Baume sulfuric acid and tap or deionized water to make 100 gal. of bath liquid. Normally, alumina content of the bath is held to under 20 g/l and chlorides as NaCl are held to under 0.2 g/l. Bath temperature is commonly about 70° F. to about 73° F. In the present invention, as described in detail below, a polyacid is substituted for at least part of the sulfuric acid and an ICP monomer is added to the bath.

The electrochemical cell, according to one embodiment of the present invention, is an anodization bath containing an anodization bath liquid and fitted with an anode and a cathode that contact the anodization bath liquid. The aluminum on which the protective coating is to be deposited acts as the anode. In commercial operations, the anodization tank is typically steel lined with lead, or acid resistant plastic and is usually equipped with a ventilation exhaust system. The remaining electrode of the electrolytic cell acts as the cathode. Cathodes suitable for use in the present invention can be made of metal, carbon, or any other suitable material commonly used for cathodes. Lead is preferred for use as a cathode and, if desired, the tank wall can be used as the cathode. Alternately, a three-electrode cell can also be used for the anodic formation of the corrosion resistant coating. This electrolytic cell utilizes a working electrode, a counter or auxiliary electrode, and a reference electrode.

Before use, the surface of the anode can be cleaned either chemically (using, for example, dilute nitric acid) or mechanically (using, for example, a file, emery cloth, or a non-steel abrasive pad) in order to remove the surface oxide coating which is often present on the surface of the metal.

An anodization bath liquid is added to the bath in an amount sufficient to cover the surface of the aluminum to be coated and the bath liquid is cooled to approximately 72° F. (about 22° C.). The subject bath liquid comprises a mixture of water, at least one polyacid and at least one ICP monomer. It is preferred that the bath liquid also contain a polybasic acid. The composition for the bath liquid comprises water; ICP monomer (such as aniline) at a concentration of from about 0.1 molar in the ICP monomer to saturated in the ICP monomer, preferably from about 0.2 molar to about 0.8 molar in the ICP monomer and more preferably from about 0.4 to about 0.6 molar in the ICP monomer; a polyacid at a concentration of from about 4% to about 20% wt/wt, based on the total weight of the mixture, preferably from about 6% to about 15% wt/wt and more preferably from about 8% to about 12% wt/wt. The composition also preferably contains a polybasic acid in a concentration of from about 0.5% to about 10% wt/wt, based on the weight of the mixture, preferably from about 1% to about 6% wt/wt and more preferably from about 1.5% to about 4% wt/wt.

If it is not important that the coating remain doped during contact or immersion with water, the multifunctional polymeric organic acid can be omitted from the bath liquid and replaced with a polybasic acid. If the multifunctional polymeric organic acid is ommitted, the polybasic acid is added to the bath in approximately the same concentration as required for the polymeric acid. Otherwise, the method for producing the coating on the aluminum anode is the same.

The components of the bath liquid can be added to the bath in any manner and sequence acceptable in common laboratory practice, but it is preferred that the aniline not be added to the bath until other bath components are present which will dissolve the aniline. The components are mixed, either before or after addition to the bath, by any conventionally used method of agitation. For example, mechanical propellers, air agitation, agitation by movement of the anode, or liquid pumps can be used to mix the bath liquid. The bath liquid is heated or cooled to the desired operating temperature prior to applying a voltage potential between the electrodes.

During operation, the electrodes are supplied with direct current from a constant voltage source. The anodization is carried out under potentiostatic conditions with the voltage held constant and with the cell current constantly dropping as the cell resistance increases due to the formation of the ICP polyacid salt/aluminum oxide coating on the aluminum surface. Preferably, the cell voltage is initally ramped up from close to 0 V to the operating voltage at the start of the anodization. Such ramping can be done within the first one or two minutes of operation. Controlled potential electrolysis of the mixture is generally carried out at an electrical potential between the anode and cathode of from about 15 volts to about 60 volts, preferably from about 20 volts to about 40 volts, and more preferably from about 25 volts to about 35 volts. It is preferable that the current density during the anodization be from about 10 to 25 milliamps/$cm^2$, or higher. Although one embodiment of the present invention is carried out at a controlled potential, one skilled in the art will readily recognize that the method may also be performed at a constant current or with variable current or potential.

Surprisingly, a potential of over 20 V, and even over 30 volts, can be used to form the coating of the present invention, whereas the prior art in the field of electrochemical polymerization of polyaniline teaches that the polymerizing voltage is limited to about 1.0–1.5 volts and demonstrates that poor quality, overoxidized films are produced at over 1.5 volts. Therefore, it is common to limit maximum cell potentials to 0.75 volts or even 0.65 volts. (See, e.g., Geskin, *J. Chem. Phys.*, 89:1221–1226, 1992, and Hyodo et al., Id). Such low cell potentials, however, are far below those normally used in commercial aluminum anodization processes and do not result in the formation of a sufficient amount of the aluminum oxide coating necessary for production of the subject coating in an acceptable period of time. Therefore, methods that use cell potentials of below about 1.5 volts for the polymerization of ICP's can not reasonably create the coating of the invention in a commercially acceptable time.

Although the inventors do not wish to be bound by this or any other particular theory, it is believed that cell voltages of over 20 volts may be used to produce the subject coating without over-oxidation of the ICP because of the electrical resistance provided by the aluminum oxide. In other words, as the composite film is formed on the aluminum surface, the aluminum oxide present in the composite film creates sufficient electrical resistance to effectively reduce the potential to which the ICP monomers are subjected to levels sufficiently low to provide polymerization, but not over-oxidation and destruction of the ICP. Thus, it is believed that the present method succeeds despite, and perhaps even because of, the formation of a relatively thin aluminum oxide layer on the skin of the aluminum and subsequent aluminum oxide formation that increases cell resistance and reduces the voltage at the interface of the coating surface. However, the cell potential does have an upper limit. Cell potentials of about 60 volts have been found to cause over-oxidation of polyaniline and to result in brown films in which there is little or none of the preferred conductive ICP polyacid salt. Another factor that may also effect the permissible cell voltage is the fact that the electrical conductivity of a polyacid such as polystyrenesulfonic acid is lower than the conductivity of sulfuric acid, a common anodization bath acid, and may reduce the voltage at the critical polymerization region.

It has also been found that, surprisingly, the electrical potential of the cell can be used to control whether a coating is produced on pure aluminum as well as on a copper-containing alloy of aluminum. When sulfuric acid is present in the bath liquid, coatings can be formed on aluminum alloys at lower cell potentials than coatings on pure aluminum. For example, coatings can be formed on aluminum alloys such as 2024 or 7075 at potentials of about 20 volts, without forming a coating on any pure aluminum that might also be present in the bath as an anode. However, if the potential is increased to about 30 volts, a coating will be formed on both the pure aluminum and the alloy.

The anodization of the present invention is carried out at a temperature from about 5° C. to about 40° C.; preferably from about 10° C. to about 30° C.; and most preferably, from about 18° C. to about 26° C. The bath liquid is usually cooled to maintain the desired temperature. The cooling can be carried out by any conventional cooling method, such as cooling coils in the bath, or by circulation of the bath liquid through an external cooling bath. Although preferred, it is not necessary that the bath liquid be agitated during anodization unless required for temperature control. Evolution of hydrogen at the cathode often provides sufficient agitation and mixing for successful operation.

The anodization is allowed to proceed at least until a coating of a thickness sufficient to provide corrosion protection is formed on the aluminum surface. This usually takes from about 5 min. to about 60 min. and a conventional time for the formation of an effective coating is about 30 min. to about 40 min. The overall thickness of a coating that results from such anodization is not critical, but is preferably from about 0.01 mil to about 1.0 mil, more preferably from about 0.1 mil to about 0.8 mil and even more preferably from about 0.3 mil to about 0.5 mil.

When the ICP monomer is aniline and a polyacid is present, the coating is green-colored, thus indicating the formation of polyaniline in the conductive salt form.

When formation of the corrosion resistant coating is complete, the cell voltage is turned off and the coated aluminum is removed from the anodization bath. After the coating is formed, it is preferred that it not be dried before being "sealed". Sealing is a well known process that is commonly used to complete the conventional anodization process for aluminum parts. In conventional procedures, sealing is carried out by immersing the oxidized aluminum surface in a bath of a chromate salt (i.e., potassium chromate, pH 5–6) at about 90° C.–100° C. However, in the present invention, it has been found that chromate is not needed in order to obtain a corrosion resistant coating and the sealing is carried out by immersing the coated aluminum in hot water (i.e., about 82° C.–100° C.) for a period of about 15 min. This is advantageous since the subject procedure eliminates the use of chromate from the anodization, thus eliminating the environmental problems associated with the use and disposal of this heavy metal.

The subject coating comprises aluminum oxide intermixed with an ICP that is doped with a polyacid. It has been found that the doped form of the ICP is preferred for this invention rather than the non-conducting base form. It has been found that coatings containing the base form of the ICP do not provide the same degree of corrosion protection as coatings containing an ICP salt. While it is important that the ICP polyacid salt component of the subject coating be conductive, it is apparently not necessary for the subject coating itself to be conductive. A coating containing the green, conductive, form of polyaniline salt was found to have very low surface conductivity, yet was effective against corrosion.

It has also been found that, surprisingly, the subject coating retains the ICP polyacid salt in its doped form even during and after immersion in water. In fact, a polyaniline-polystyrenesulfonic acid salt/aluminum oxide coating of the present invention that was doped with polystyrenesulfonic acid has retained its green color (indicating the conductive form of polyaniline) after immersion in near-boiling water for over 30 minutes. This important property of the subject coating permits the coating to be sealed in hot water at a conventional time and temperature without losing its corrosion resistance. For example, the ICP of the subject coating is capable of remaining in the doped, salt, form after immersion for 15 minutes in water at a temperature of 60° C. Preferably, the ICP remains in the salt form after immersion for 15 min., or longer, in water at 82° C., or more preferably, at 99° C., and most preferably in boiling water. Because the coating has been shown to be stable in hot water, it is to be expected that it is also stable under exposure to normal environmental conditions of ambient temperature when the coating may be periodically wetted by rain or snow.

As described previously, if a polybasic acid is used in the bath liquid in place of a polyacid, a similar coating comprising aluminum oxide intermixed with a polybasic acid salt of an ICP is obtained, except that the polybasic acid salt of the ICP will not remain in a doped form during immersion in hot water, as will a coating containing a polyacid salt of an ICP.

The coating of the present invention is useful for the same purposes as any other protective or decorative coating on aluminum and aluminum alloys. A major use of the coating is in providing corrosion resistance to any aluminum or aluminum alloy surface. One of the advantageous features of the subject coating is its ability to protect an aluminum surface from pitting type corrosion, even when the surface is exposed to salt and acidic environments. While heavy metals, such as chromates, are normally used to protect against such corrosion, the subject coating has demonstrated significantly reduced pitting corrosion in a salt-fog test. Moreover, the use of a polyacid as the ICP dopant permits corrosion protection to extend into neutral or even slightly basic environments.

The coating also provides a tough and adherent film on aluminum that can serve as an undercoat for painting or subsequent coating. One of the most useful applications for the present coating is in the aircraft industry to provide a method to stabilize aluminum sheets and parts used in aircraft construction against environmental damage. Such protection can improve not only the appearance, but can also protect the structural integrity and extend the useful life of the aircraft.

The following examples describe preferred embodiments of the inventions. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples.

COMPARATIVE EXAMPLE 1

Attempted electropolymerization of polyaniline onto aluminum in aqueous phosphoric acid by cycling voltage between about −0.4–+1.5 volts versus Ag/AgCl.

A phosphoric acid electrolyte was prepared by adding 85% phosphoric acid (21 g, 0.25 moles) to water (84 g, 4.67 moles). An aluminum (2000 series) anode was placed in 15.5 ml of the electrolyte in a standard electrochemical cell along with a platinum cathode and a Ag/AgCl reference electrode. A cyclic voltammetric scan between about −0.5 and +1.5 volts showed a large oxidation wave commencing at about −0.4 volts that was attributed to oxidation of aluminum. Addition of aniline (0.1 ml, 0.0011 moles) to the electrolyte changed the shape of the voltammetric scan, but the scan did not exhibit any distinguishing features characteristic of aniline oxidation. Under these conditions, aluminum oxidizes in the bath and a polyaniline film is not formed.

On a platinum electrode (anode), under the same conditions as above, aniline oxidizes at +1.1 volt. Continued cycling through the aniline oxidation wave results in formation of polyaniline as indicated by the appearance of the reversible redox couple at about +0.4 volt.

EXAMPLE 1

This example illustrates the formation of a coating of the polystyrenesulfonic acid salt of polyaniline intermixed with aluminum oxide on aluminum alloy 2024.

A piece of 2024 aluminum alloy (obtained from McDonnell Douglas Company, St. Louis, Mo.) was cut to fit into a 500 ml beaker. A graphite cathode and a Ag/AgCl reference electrode were also placed in the beaker and the aluminum alloy panel was connected as the anode to a Sorenson Model 300-25 power source. The beaker was filled with an aqueous solution of 10% wt/wt polystyrenesulfonic acid (PSSA, obtained from PolySciences, Inc.) and 1.7% wt/wt sulfuric acid to act as an electrolyte. Sufficient aniline (Aldrich Chemical Co.) was added to make the solution 0.5 molar in aniline. The aluminum was anodized at 30 V at room temperature for 15 minutes. A light green anodic polyaniline/aluminum oxide layer was obtained on the aluminum. The porous anodic oxide was heat-sealed by immersing the aluminum panel in boiling water for 15 minutes. The water treatment did not change the color of the coating.

COMPARATIVE EXAMPLE 2

This example illustrates the loss of polyaniline dopant during heat sealing when sulfuric acid is used to form the polyaniline salt rather than a multifunctional polymeric organic acid.

The coating formation method described in Example 1 was repeated except that the PSSA of Example 1 was replaced with 10% wt/wt sulfuric acid and 1% wt/wt polystyrenesulfonic acid. After the anodization was completed, a green film was again formed on the aluminum indicating formation of the conductive, emeraldine salt form of polyaniline. After removing the coated panel from the anodization bath, it was hot water sealed by immersing it in water at 82° C.–99° C. for 15 min. It was noticed that contact with the hot water changed the coating from a green color to a blue color. This indicated deprotonation of the polyaniline and conversion of the polyaniline to the nonconductive emeraldine base form.

EXAMPLE 2

This example illustrates the formation of a porous aluminum oxide coating during anodization in the presence of a polybasic acid.

The coating formation method described in Comparative Example 1 was repeated. After the anodization was completed, a green film had been formed on the aluminum indicating formation of the conductive, emeraldine salt form of polyaniline. Before hot water sealing of this panel, a cross-sectional sample was cut from the panel with a diamond knife. A light microscope was used to obtain annular dark-field photomicrographs of three different views of the cross section of the coating and aluminum alloy surface along this cut.

FIG. 1(*a*) shows the cross section of the coating on the surface of the alluminum alloy with copper concentrations in the alloy identified. The aluminum is at left and aluminum oxide at right in the photograph. FIG. 1(*b*) shows a different view of the same cross sectional cut with aluminum metal at left and aluminum oxide at right. In this figure, the "pillar" type of aluminum oxide typical of aluminum oxide formed in the presence of a polybasic acid can be seen. Again, bright spots of copper concentration can be seen in the aluminum. FIG. 1(*c*) shows a third view of the cross section of the same coating further showing formation of the "pillar" type of aluminum oxide. All three figures illustrate that the aluminum oxide is closely attached to and integral with the aluminum metal surface. Indeed, the aluminum oxide is seen to be growing out of the surface of the aluminum as opposed to being painted on the surface. The figures also show the highly irregular, porous, structure of the aluminum oxide.

The integral nature of the aluminum and the coating can also be seen in FIGS. 2(*a*) through 2(*d*), which are elemental maps of the same cross sectional view as shown in FIG. 1(*c*). These views were obtained as energy dispersive X-ray maps obtained in a dedicated scanning transmission electron microscope.

FIGS. 2(*a*), 2(*b*), 2(*c*) and 2(*d*), respectively, show the distribution of molecules of oxygen, aluminum, sulfur and copper in the coating cross section. As shown in FIGS. 2(*a*) and 2(*b*), the surface of the aluminum metal (on the left) is seen to blend into and be covered by the aluminum oxide (on the right). FIG. 2(*c*) shows that, as expected, sulfur concentration is higher in the coating than in the alloy and FIG. 2(*d*) shows again the concentrations of copper in the 2024 aluminum alloy.

Figure 3:
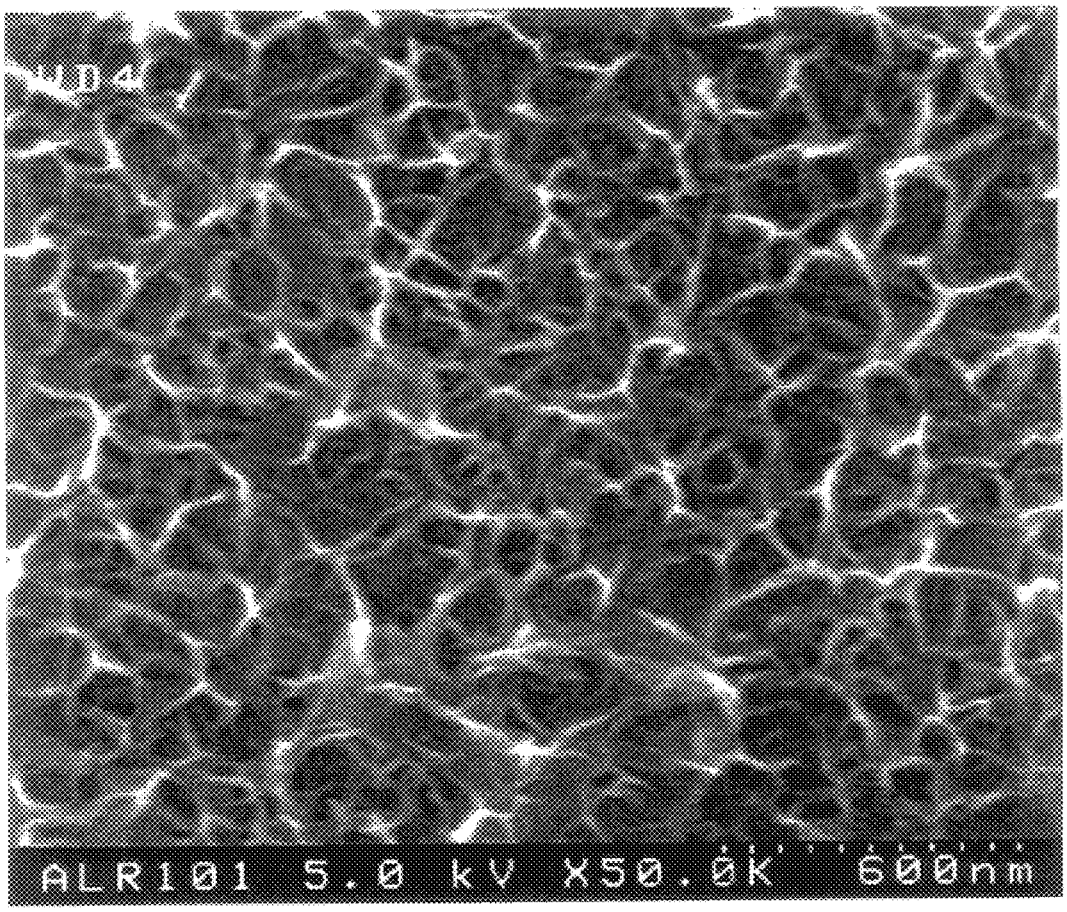
FIG. 3 is a high resolution scanning electron micrograph of the surface of the same film as shown in FIG. 1, showing the highly porous and irregular structure of the outer surface of the aluminum oxide/polyaniline film before sealing in hot water.

FIG. 3 is a high resolution scanning electron micrograph of the surface of the same film as shown in FIG. 1, showing the highly porous and irregular structure of the outer surface of the aluminum oxide/polyaniline film before sealing in hot water. It would be expected that the process of hot water sealing would cause the aluminum oxide to flow into a smoother and less porous surface, perhaps entrapping some part of the ICP that had been formed with the oxide.

EXAMPLE 3

This example shows the improved resistance to pitting-type corrosion of a coating of the present invention having a green, conductive salt form of the polyaniline rather than a blue, nonconductive neutral form.

One panel of 2024 aluminum was coated as described in Example 1 (aluminum oxide/polyaniline-PSSA-doped) and another was coated as described in Comparative Example 2 (aluminum oxide/polyaniline-$H_2SO_4$-doped). Both panels were hot water sealed by immersion in boiling water for 15 minutes. The PSSA-doped panel remained green after sealing. This indicated that the polyaniline remained in a doped, or salt form. However, the panel doped with sulfuric acid turned blue during the sealing process, indicating that the polyaniline was de-doped and was left in the base form.

Figure 4A:
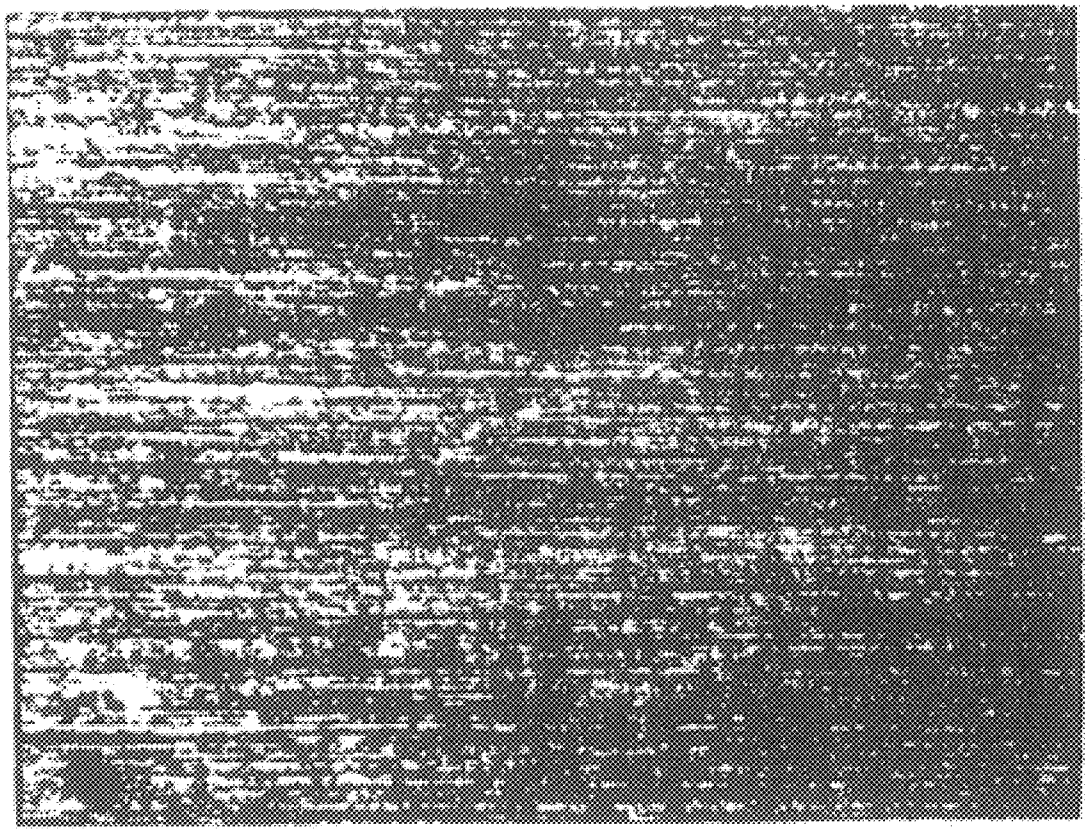
FIGS. 4*a–c* show photomicrographs taken at 30 × of panels of aluminum alloy 2024 that had been, (a) coated with an aluminum oxide/polystyrenesulfonic acid-doped polyaniline coating, hot water sealed, and exposed to salt fog for six hours, (b) left uncoated and without any salt fog exposure and, (c) coated with an aluminum oxide/sulfuric acid-doped polyaniline coating, hot water sealed, and exposed to salt fog for six hours with resultant pitting.
Figure 4B:
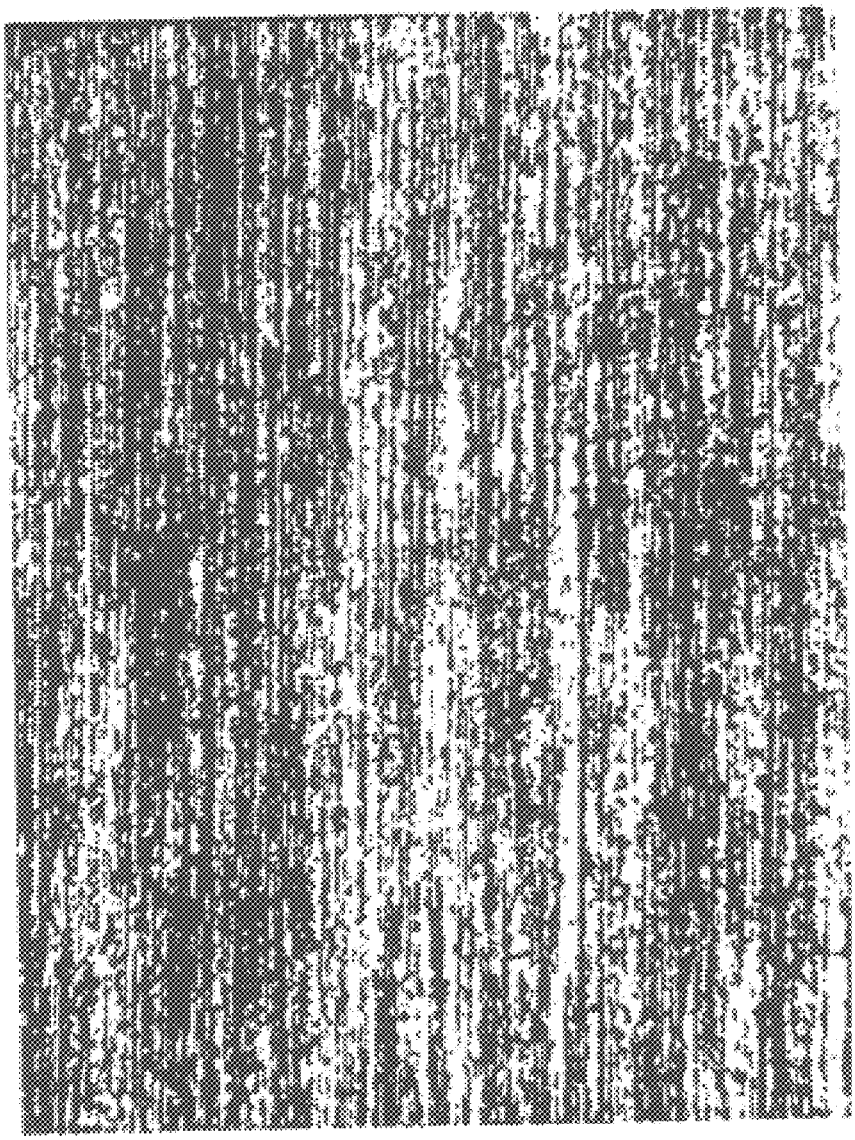
Figure 4C:
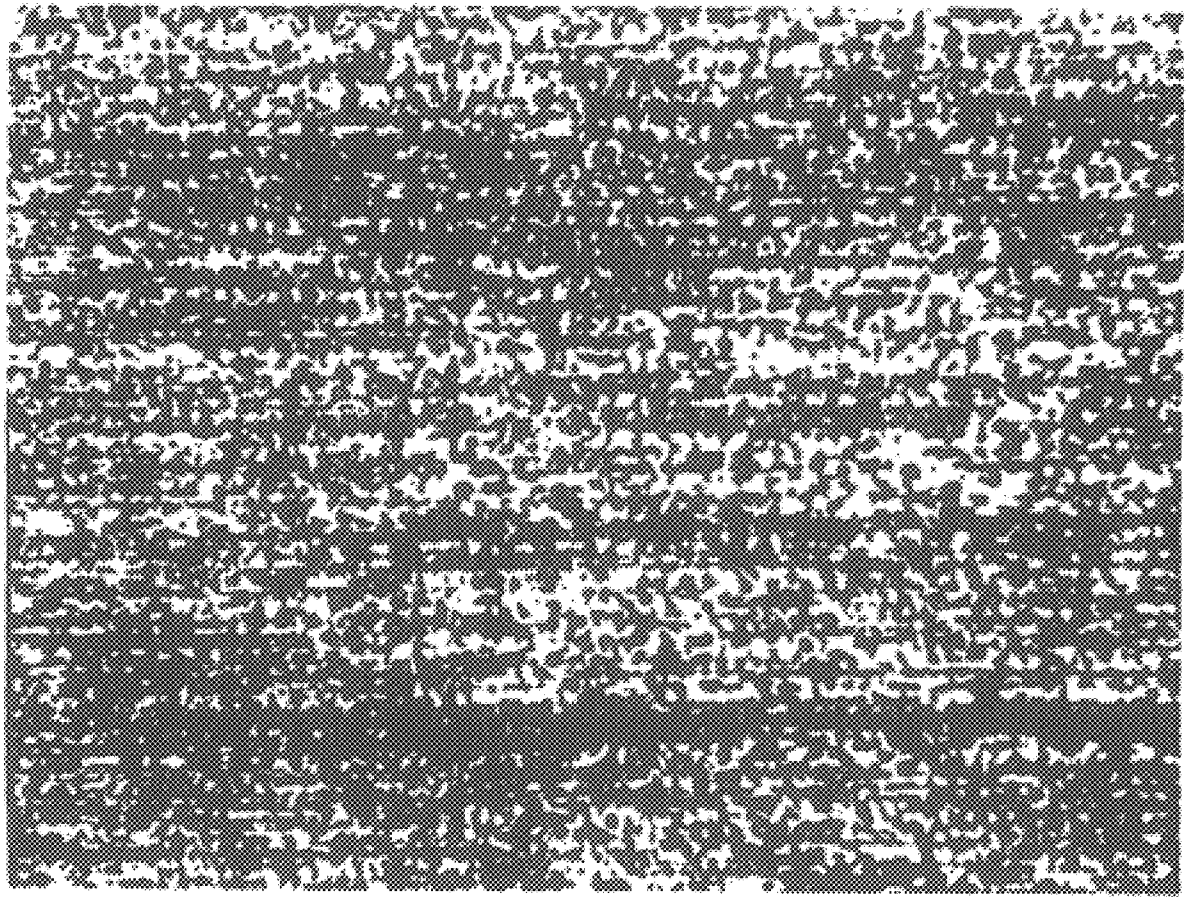

Both panels were subjected to exposure to salt fog according to conditions specified in ASTM B117 for 6 hrs. The panels were then rinsed and dried and examined for pitting-type corrosion under a light microscope at a magnification of approximately 30 ×. The panel that had been coated with the PSSA-doped polyaniline/aluminum oxide (as shown in FIG. 4(*a*) showed no signs of pitting-type corrosion and appeared substantially the same as a panel of the same type of aluminum that had not been coated or exposed to the salt fog (as shown in FIG. 4(*b*). However, the panel that had been coated with the sulfuric acid-doped polyaniline/aluminum oxide exhibited a number of small pits across the entire exposed surface of the panel (as shown in FIG. 4(*c*). This indicated that aluminum oxide/polyaniline-PSSA-doped protected the aluminum surface from pitting-type corrosion significantly better than aluminum oxide/polyaniline-sulfuric acid-doped after the coatings had been hot water sealed.

EXAMPLES 4–10

These examples illustrate the effect of anodization cell voltage on the quality of the polyaniline deposited as a part of the aluminum oxide/polyaniline coating on aluminum alloys.

To an anodization bath was added deionized water (2.34 liters), polystyrenesulfonic acid (1.22 liters of 30% wt/wt PSSA with 5% $H_2SO_4$, available from Polysciences, Inc.) and 0.19 liter aniline. Final bath concentration was about 10% wt/wt PSSA, 1.6% wt/wt $H_2SO_4$, and 0.5 molar aniline. The bath liquid was cooled to 70° F. and maintained at that temperature throughout the anodization. A lead cathode was used and the voltage was measured against a Ag/AgCl reference electrode. Test panels of 2024-T3 and 7075-T6 aluminum were suspended in the bath by 1100 series aluminum wires to act as the anodes. In Example 4, the voltage was set at 60 V without any ramping, the cell initally drew about 25 amps and quickly dropped to 0 amps. The panels had a "burnt" and "rough" appearance that was ascribed to overoxidation of the polyaniline. The panels were not sealed. The panels in Example 5 were anodized in the same manner, but using 70 volts. They had a worse appearance than those of Example 4 in terms of being overoxidized, brown and "burnt".

In Example 6, the voltage was ramped from about 0 V to 40 V within the first minute and maintained at 40 V for 30 min. The panels and the series 1100 aluminum wire exhibited a uniform green sheen indicating presence in the coating of the conductive form of polyaniline. The panels were hot water sealed by immersion in 82° C.–99° C. water for 15 minutes and the green color of the coating was maintained.

In Examples 7–10, 2024-T3 was the only alloy used. In Example 7, the voltage was ramped from 0 V to 40 V and run at 40 V for 30 minutes. A coating with a green sheen was formed on the panel. In Examples 8 and 9, the voltage was ramped from 0 V to 50 V and 60 V, respectively, and held at those levels for 30 minutes. The coatings for both samples, however were very grey and rough and exhibited no green color indicative of conductive polyaniline. Therefore, in Example 10, anodization at 40 V, as in Example 7, was repeated and again a green coating was formed.

Upon microscopic examination, the panels from Examples 7 and 10 exhibited frequent small green "dots" over the entire surface. These were attributed to be the polyaniline salt of PSSA.

EXAMPLE 11

This example illustrates the coating of aluminum alloy but not pure aluminum at 20V and the coating of both alloy and pure aluminum at 30V.

The coating formation method described in Comparative Example 2 was repeated on samples of 2024-T3, 7075-T6 and 6061-T6 bare aluminum suspended in the bath liquid by an aluminum wire (1100 series) except that the voltage was maintained as 20 volts for 30 minutes. Upon removal from the bath it was noted that all samples had undergone a color change and the 2024 was deep metallic green, the pure aluminum wire, however, showed no color change at all. This indicated that although polyaniline formed on the copper-containing aluminum alloys at 20 V, it did not form on the pure aluminum wire. Anodization under the same conditions, except at 30 V, showed that a green coating was formed on the aluminum wire as well as on the aluminum alloy.

In view of the above, it will be seen that the several advantages of the invention are achieved and other advantageous results obtained.

As various changes could be made in the above methods and compositions without departing from the scope of the invention, it is intended that all matter contained in the above description and shown in the accompanying drawings shall be interpreted as illustrative and not in a limiting sense.

What is claimed is:

1. A method for protecting an aluminum surface from corrosion comprising, contacting the aluminum surface with a mixture of water, a multifunctional polymeric organic acid and a monomer of an intrinsically conductive polymer and imposing an electrical potential between the aluminum surface as the anode and a cathode, where the electrical potential is sufficient to polymerize the monomer of the intrinsically conductive polymer and to form aluminum oxide, thereby forming on the aluminum surface a coating of the multifunctional polymeric organic acid salt of the intrinsically conductive polymer intermixed with aluminum oxide.

2. A method as set forth in claim 1, wherein the electrical potential is between about 15 volts and 60 volts.

3. A method as set forth in claim 1, wherein the electrical potential is between about 20 volts and 40 volts.

4. A method as set forth in claim 1, wherein the electrical potential is between about 25 volts and 35 volts.

5. A method as set forth in claim 1, wherein a polybasic acid in addition to the multifunctional polymeric acid is present in said mixture.

6. A method as set forth in claim 1, with the added step of contacting the film with water at a temperature of at least about 60° C. for a period of at least about 15 minutes.

7. A method for forming a coating on an aluminum surface comprising, contacting the aluminum surface with a mixture of water, a polybasic acid and a monomer of an intrinsically conductive polymer and imposing an electrical potential of at least about 15 volts between the aluminum surface as the anode and a cathode, thereby polymerizing the monomer of the intrinsically conductive polymer and forming aluminum oxide and thereby forming on the aluminum surface a coating of the polybasic acid salt of the intrinsically conductive polymer intermixed with aluminum oxide.

8. A method as set forth in claim 7, wherein the polybasic acid is sulfuric, oxalic, phosphoric, boric, salicic, sulfonic, or phosphonic.

9. A method as set forth in claim 8, wherein the electrical potential is at least about 20 volts.

10. A method as set forth in claim 1, wherein the multifunctional polymeric organic acid is selected from the group consisting of poly(styrene sulfonic acid), poly(styrene phosphonic acid), poly(vinyl sulfuric acid), poly(vinyl sulfonic acid), poly(lactic acid), poly(aspartic acid), poly(glycolic acid), poly(vinyl phosphonic acid), poly(acrylic acid), poly (methacrylic acid), poly(2-acrylamido-2-methyl-1-propene sulfonic acid), poly(butadiene-maleic acid), and copolymers thereof.

11. A method as set forth in claim 1, wherein the multifunctional polymeric organic acid comprises poly(styrene sulfonic acid).

12. A method as set forth in claim 1, wherein the multifunctional polymeric organic acid has a weight average molecular weight of about 20,000 to about 150,000.

13. A method as set forth in claim 1, wherein the monomer of an intrinsically conductive polymer comprises monomer units of substituted or unsubstituted aniline, pyrrole, thiophene, phenylene sulfide, p-phenylene, phenylene vinylene, carbazole, thienylene vinylene, acetylene, isothianaphthene, or mixtures thereof.

14. A method as set forth in claim 1, wherein the monomer of an intrinsically conductive polymer comprises monomer units of aniline.

15. A method as set forth in claim 1, wherein the multifunctional polymeric organic acid salt of an intrinsically conductive polymer comprises the poly(styrene sulfonic acid) salt of polyaniline.

16. A method as set forth in claim 5, wherein the polybasic acid is selected from the group consisting of sulfuric, oxalic, phosphoric, boric, salicic, sulfonic, and phosphonic.

17. A method as set forth in claim 5, wherein the polybasic acid comprises sulfuric acid.

18. A method for protecting an aluminum surface from corrosion comprising, contacting the aluminum surface with a mixture of water, a multifunctional polymeric organic acid and a monomer of an intrinsically conductive polymer and imposing an electrical potential of al least about 15 volts between the aluminum surface as the anode and a cathode, thereby forming on the aluminum surface a coating of the multifunctional polymeric organic acid salt of the intrinsically conductive polymer intermixed with aluminum oxide.

19. A method as set forth in claim 18, wherein the multifunctional polymeric organic acid is selected from the group consisting of poly(styrene sulfonic acid), poly(styrene phosphonic acid), poly(vinyl sulfuric acid), poly(vinyl sulfonic acid), poly(lactic acid), poly(aspartic acid), poly (glycolic acid), poly(vinyl phosphonic acid), poly(acrylic acid), poly(methacrylic acid), poly(2-acrylamido-2-methyl-1-propene sulfonic acid), poly(butadiene-maleic acid), and copolymers thereof.

20. A method as set forth in claim 18, wherein the multifunctional polymeric organic acid comprises poly (styrene sulfonic acid).

21. A method as set forth in claim 18, wherein the multifunctional polymeric organic acid has a weight average molecular weight of about 20,000 to about 150,000.

22. A method as set forth in claim 18, wherein the monomer of an intrinsically conductive polymer comprises monomer units of substituted or unsubstituted aniline, pyrrole, thiophene, phenylene sulfide, p-phenylene, phenylene vinylene, carbazole, thienylene vinylene, acetylene, isothianaphthene, or mixtures thereof.

23. A method as set forth in claim 18, wherein the monomer of an intrinsically conductive polymer comprises monomer units of aniline.

24. A method as set forth in claim 18 wherein the multifunctional polymeric organic acid salt of an intrinsically conductive polymer comprises the poly(styrene sulfonic acid) salt of polyaniline.

25. A method as set forth in claim 18, wherein the electrical potential is at least about 20 volts.

26. A method as set forth in claim 18, wherein the mixture further comprises a polybasic acid.

27. A method as set forth in claim 26, wherein the polybasic acid is selected from the group consisting of sulfuric, oxalic, phosphoric, boric, salicic, sulfonic, and phosphonic.

28. A method as set forth in claim 26, wherein the polybasic acid comprises sulfuric acid.

* * * * *

UNITED STATES PATENT AND TRADEMARK OFFICE

CERTIFICATE OF CORRECTION

PATENT NO. : 6,328,874 B1
DATED : December 11, 2001
INVENTOR(S) : Kinlen et al.

It is certified that error appears in the above-identified patent and that said Letters Patent is hereby corrected as shown below:

Title page,
Item [56], References Cited, OTHER PUBLICATIONS, "188-129" should read -- 118-129 --.

Column 20,
Line 48, "al" should read -- at --.

Signed and Sealed this

Twenty-seventh Day of August, 2002

*Attest:*

*Attesting Officer*

JAMES E. ROGAN
*Director of the United States Patent and Trademark Office*